United States Patent [19]

Pemper

[11] 4,100,669

[45] Jul. 18, 1978

[54] CASTING PROCESS

[76] Inventor: Steven J. Pemper, 1638 W. Pierce St., Milwaukee, Wis. 53204

[21] Appl. No.: 682,991

[22] Filed: May 4, 1976

Related U.S. Application Data

[60] Continuation-in-part of Ser. No. 554,559, Mar. 3, 1975, abandoned, which is a division of Ser. No. 302,731, Nov. 1, 1972, abandoned.

[51] Int. Cl.[2] ..... B22D 19/00

[52] U.S. Cl. ..... 29/527.6; 148/2; 164/111

[58] Field of Search ..... 164/111; 29/527.6, 196.1, 29/191.6; 148/13, 151, 2, 3, 12.4, 39

[56] References Cited

U.S. PATENT DOCUMENTS

| | | | |
|---|---|---|---|
| 1,630,631 | 5/1927 | Pauly | 29/191.6 X |
| 2,254,307 | 9/1941 | Mott et al. | 148/151 |
| 3,118,225 | 1/1964 | McAndrews | 29/527.6 |

*Primary Examiner*—Francis S. Husar
*Assistant Examiner*—Gus T. Hampilos
*Attorney, Agent, or Firm*—Andrus, Sceales, Starke & Sawall

[57] ABSTRACT

A method for producing large castings formed of non-machinable metals provides for inserting machinable plug members in the mold prior to casting, then pouring molten hard metal to fill the mold and surround the inserts. Removing the mold exposes the casting and portions of the inserts which may then be machined. After machining, the inserts are flame-hardened commensurate with the hardness of the casting.

5 Claims, 7 Drawing Figures

CASTING PROCESS

This is a Continuation-in-Part of application Ser. No. 554,559 filed on Mar. 3, 1975, now abandoned, which in turn is a division of Ser. No. 302,731, filed Nov. 1, 1972, now abandoned.

This application relates generally to metal castings and more particularly to a method of casting large objects from non-machinable metals and including therewith machinable inserts which, after machining, are flame-hardened to a degree of hardness commensurate with the main casting.

Castings formed from extremely hard metals find application in such uses as armor plate for tanks, heads for crushing machines or tractor treads for heavy earth-moving equipment. Forming such castings from hard metals such as manganese steel results in a casting of exceptional strength and hardness; however, the very hardness desired for the use to which the casting is to be put often creates problems when the need arises to machine such castings to final tolerances for accurate construction and assembly. Heretofore, foundrymen faced with producing a large metal part to close tolerances have been forced to compromise in the formulation of the metal by selecting a metal softer than desired to allow for the necessary machining operations. The obvious result of such compromise is that the parts wear out more quickly and must be replaced more often, resulting in expensive stretches of downtime and lower production.

Accordingly, my invention has the following objects:

To provide methods for casting metal parts formed from non-machinable metals with accurately placed softer metal inserts contained therewith to allow for subsequent machining;

To provide such methods capable of casting extremely large and precisely toleranced metal pieces;

To provide such methods whereby the location of the softer metal inserts may be precisely set;

To provide such methods whereby the softer metal inserts, after machining, are flame-hardened to a degree commensurate with the hardness of the casting itself.

These and other objects will become more apparent upon a consideration of the drawings in which:

FIG. 1 is a sectional plan view of a commercial castings polisher;

FIG. 2*a* is a top plan view of one flight used in the conveyor of said castings polisher;

FIG. 2*b* is a top plan view of a connecting link for said conveyor;

FIG. 3*a* is a partial lateral sectional view of a wooden pattern and the sand mold used for casting said flight;

FIG. 3*b* is a partial lateral sectional view of the resulting sand mold with machinable inserts positioned therein immediately prior to the pouring of molten metal;

Figure 1:
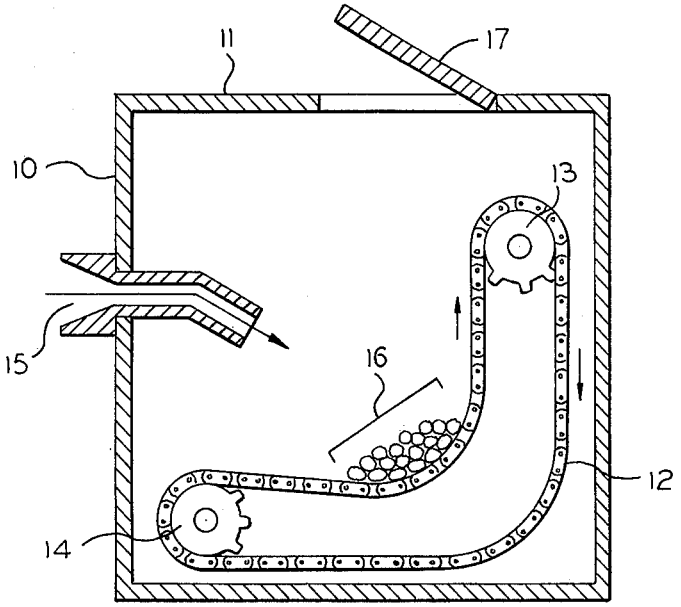

Consistent with the foregoing objects, applicant herein provides a process for producing large castings 18 of non-machinable metal with accurately placed machinable inserts 26 during which process sand shells 21 and 22 are formed about a wooden pattern 20 constructed to the shape and size desired for casting 18.

Pattern 20 is then removed and machinable inserts 26 aligned in shells 21 and 22. Molten hard metal is then poured into shells 21 and 22 substantially surrounding inserts 26 and the resulting casting is allowed to cool. Inserts 26 may then be machined to align casting 18 during construction and assembly.

Referring now to FIG. 1, the numeral 10 indicates, generally, a schematic drawing of a commercial castings polisher consisting, generally, of housing 11, conveyor 12 mounted on sprockets 13 and 14, and inlet 15. Castings 16 are placed in polisher 10 through hatch 17. In operation, a mixture of sand and compressed air is injected through inlet 15, as conveyor 12 is rotated by sprockets 13 and 14 as shown. This causes the castings to tumble in the sand/air stream, thereby smoothing and polishing the castings to remove surface irregularities.

Figure 2A:
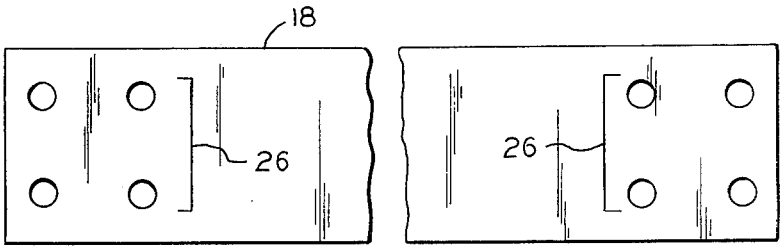
Figure 2B:
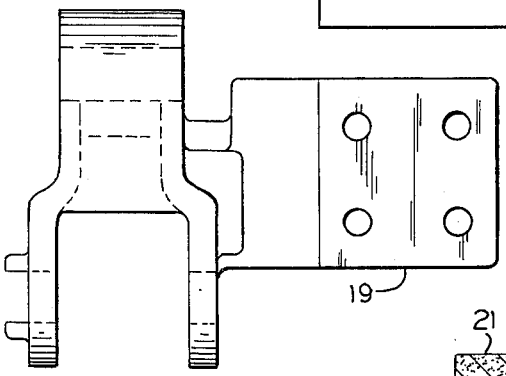

The foregoing description of the castings polisher 10 is exemplary of a commercial application in which large machine components must be fabricated from as hard a metal as is possible. Conveyor belt 12 includes a number of individual links, or "flights" 18, as illustrated in FIG. 2. In a typical application, each such flight is from $1\frac{1}{2}$ inches to 2 inches thick and is 95 inches in length and 6 inches in width, resulting in a casting weighing between 450 and 500 lbs. In the castings polisher illustrated herein, 50 such flights are required to complete the conveyor belt. Such flights are linked together by connecting links 19 of FIG. 2, and are arranged to overlap slightly, thereby preventing small castings from slipping between flights as conveyor 12 turns.

When individual flights are assembled to form conveyor 12, it has been found that such flights must align precisely if conveyor 12 is to pass smoothly over sprockets 13 and 14, and if accurate overlapping of flights is to be maintained. Correct alignment is difficult to obtain unless individual flights may be machined to acceptable work tolerances, since the casting of such large metal components is difficult to achieve within extremely small tolerances often of the order of $\pm$ 0.005 inches.

Figure 3A:
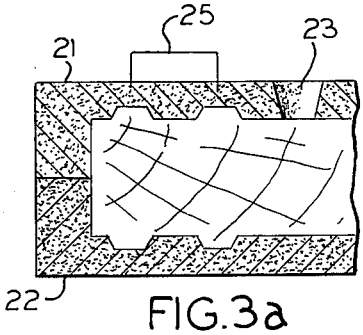

Such casting is usually carried out through use of a sand mold as illustrated in FIG. 3. A pattern 20 customarily formed from wood or metal is shaped to the dimension and size of the piece to be cast. Wet sand is then compressed about pattern 20 to form a mold having sand shells 21 and 22. Pattern 12 is then removed and molten metal is poured into the mold through sprue 23 until the metal appears in riser 24, thus assuring that the entire mold is filled. When the metal has cooled it is removed from the mold and sent for finishing and machining. It is not unusual for such castings to warp slightly; if such warpage is extreme, the entire casting must be scrapped. If warpage is mild, the casting must be machined to align it.

Since conveyor 12 is subject not only to impact from hard metal castings, but from the air/sand mixture as well, it is imperative that flights 18 be formed of as hard a metal as is practicable. Previous attempts to form such flights have been hampered by the fact that any metal hard enough to adequately serve as a flight material is simultaneously too hard to be machined. Consequently, past attempts at manufacturing flights have used softer metals which are machinable to the tolerances required for such machinery, yet which do not withstand the rigors of tumbling castings and abrasive sand nearly as well as the harder alloy steels, such as manganese steel. Consequently, the wear on such flights often requires flights to be replaced: an expensive and time-consuming process which effectively removes the castings polisher 10 from use while being repaired.

Such flights 18 may be cast according to my improved process whereby hard steels such as manganese steel may be utilized to form the flights, yet a degree of machinability may be maintained to allow accurate flight assembly and alignment.

Figure 3B:
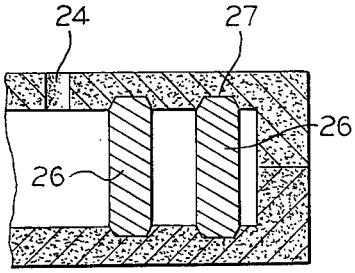

Referring to FIG. 3, when pattern 20 is prepared, projections 25 are formed thereon and corresponding indentations are formed in shells 21 and 22. After pattern 20 has been removed, but before the pouring of molten metal has commenced, inserts 26 are positioned in the depressions 27 formed by projections 25, as illustrated in FIG. 3*b*. Such inserts, in one embodiment, are formed from a relatively softer metal. Projections 25 on pattern 20 must be formed and positioned accurately and must result in depressions 27 of sufficient debth to firmly hold inserts 26 within shells 21 and 22, since, if during pouring inserts 26 come loose, or misalign, the entire casting must be scrapped.

Molten hard metal is next poured into shells 21 and 22 through sprue 23, effectively surrounding the inserts on all sides, save that portion of each insert formed by projections 25. The resulting cast flight 18 is then allowed to cool.

Figure 4:
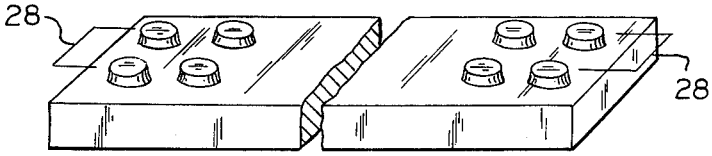
FIG. 4 is a perspective view of the cast flight prior to machining.

As is evident in FIG. 4, when flight 18 is removed from the mold, faces 28 of inserts 26 are exposed and may be machined. Since, in a casting the size of flight 18 some irregularity or warpage may be present, assembly of conveyor 12 may necessitate grinding of faces 28, as well as drilling and tapping of inserts 26 to allow connecting links 19 be maintained in as horizontally parallel alignment as possible to allow for smooth travel of conveyor 12 over sprockets 13 and 14.

Figure 5:
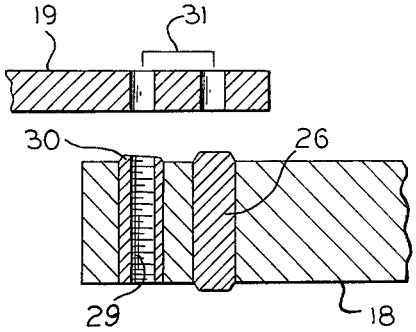
FIG. 5 is a partial sectional view illustrating the required alignment of said connecting link with said flight.

As FIG. 5 illustrates, inserts 26 may not only be drilled and tapped, as illustrated at 29, but may also be ground in such a manner as to horizontally align the connecting links used for each flight, as shown at 30. Inserts 26 may also be drilled and tapped slightly off-center if necessary to correctly align mounting apertures 31 of connecting links 19 to flight 18. In effect, this allows a manufacturer to alter slightly the position of the tapped holes on the finished casting. Since, as mentioned previously, tolerances of $\pm$ 0.005 inches are not uncommon, it can be seen that my process provides a means for positioning such holes which is far superior in terms of accuracy than attempting to mold such holes correctly in place during the casting process.

Inserts 26 may be flame-hardened after machining to obtain a hardness approaching that of flight 18: the resulting finished product is an extremely hard and durable metal flight capable of precise alignment in a conveyor belt but incapable of further machining.

Use of such casting processes find application in a wide variety of products, all sharing a common need for a working surface unusually resistant to abrasion, wear and impact.

A typical use of my process would then include the following steps and rocedures:

A wooden or metal pattern would be prepared to the shape and dimension of the piece to be cast. Sites are selected for machinable, soft inserts corresponding to those points on the finished casting to which drilling, tapping, grinding or other machining operations must be performed, and corresponding projections are formed on the wooden pattern.

Moist sand is then pressed about the pattern to create a cavity corresponding to the shape and dimension of the pattern. After the pattern has been removed, the soft metal inserts are placed precisely in alignment with the projections formed by the pattern and are thus held firmly within the mold. Molten hard metal is then inserted into the mold through a sprue opening surrounding the metal inserts on all sides, save that portion encompassed by the pattern projections and the resulting casting is allowed to cool. When cooling is complete, the mold is removed and further necessary machining operations may then be carried out on the soft metal inserts. After such machining has been completed, the inserts, or the inserts and the entire casting, may then be flame or heat treated to maximize hardness.

In some instances it will be advantageous to machine the inserts prior to the casting operation and such may readily be accomplished. Such inserts may also be formed with surface projections or irregularities to aid in mechanically joining the inserts to the finished casting. In this manner, a large casting of non-machinable hard metal may be afforded that degree of machinability necessary to align or shim the casting prior to final installation and assembly. Machine components formed from such hard metal castings are less subject to wear, calling for less frequent replacement and repair, and less downtime.

While the foregoing has presented a specific embodiment, it is to be understood that this embodiment is presented by way of example only and is not intended to limit the scope of the claims presented herewith. It is expected that other skilled in the art will perceive variations which, while differing from the foregoing, are within the spirit and scope of the claims.

I claim:

1. A process for producing castings, comprising the steps of forming a mold to the shape and dimensions of a casting, forming a depression in the interior surface of said mold, positioning an end portion of a insert of a machinable metallic meterial in said depression, casting a second metallic material having a substantially greater hardness than said first metallic material in said mold and substantially surrounding said insert, cooling said casting, removing said mold with said end portion of the insert projecting beyond the casting, machining the projecting end portion of the insert, and thereafter hardending the machined end portion of the insert.

2. The method of claim 1, wherein said step of machining comprises tapping a hole in the projecting end portion of said insert.

3. A process for producing castings, comprising the steps of forming a mold to the shpae and dimension of the casting, forming in the inner surface of the mold at least one depression, positioning the end portion of an insert of a machineable metallic material in said depression, casting a second metallic material having a substantially greater hardness than said first metallic material in said mold and substantially surrounding said insert, cooling said casting, removing said mold with the end portion of said insert projecting beyond the outer surface of said casting, machining the projecting end portion of the insert, and hardening the machined end portion to provide said insert with a hardness substantially similar to that of said cast second metallic material.

4. The method of claim 3, wherein said machining comprises the step of tapping an opening in the projecting end portion of said insert.

5. The method of claim 3, wherein said step of hardening comprises flame hardening.

* * * * *

UNITED STATES PATENT AND TRADEMARK OFFICE

CERTIFICATE OF CORRECTION

PATENT NO. : 4,100,669

DATED : July 18, 1978

INVENTOR(S) : STEVEN J. PEMPER

It is certified that error appears in the above-identified patent and that said Letters Patent are hereby corrected as shown below:

Column 1, line 35, Cancel "therewith" and substitute therefor ---therewithin---, Column 3, Line 58, Cancel "rodecures" and substitute therefor ---procedures---, Column 4, Line 36, CLAIM 1, Cancel "a", first occurrence, and substitute therefor ---an---, Column 4, Line 44, CLAIM 1, Cancel "dending" and substitute therefor ---dening---, Column 4, Line 49, CLAIM 3, Cancel "shpae"and substitute therefor ---shape---

Signed and Sealed this

*Third* Day of *April 1979*

[SEAL]

*Attest:*

RUTH C. MASON
*Attesting Officer*

DONALD W. BANNER
*Commissioner of Patents and Trademarks*